US009113532B2

(12) United States Patent
Naruo et al.

(10) Patent No.: US 9,113,532 B2
(45) Date of Patent: Aug. 18, 2015

(54) LIGHT EMITTING DEVICE AND ILLUMINATION APPARATUS HAVING SAME

(75) Inventors: Masahiro Naruo, Osaka (JP); Shigeru Ido, Osaka (JP); Sana Esaki, Osaka (JP); Akinori Hiramatu, Osaka (JP)

(73) Assignee: PANASONIC INTELLECTUAL PROPERTY MANAGEMENT CO., LTD, Osaka (JP)

( * ) Notice: Subject to any disclaimer, the term of this patent is extended or adjusted under 35 U.S.C. 154(b) by 190 days.

(21) Appl. No.: 13/495,060

(22) Filed: Jun. 13, 2012

(65) Prior Publication Data

US 2012/0319602 A1 Dec. 20, 2012

(30) Foreign Application Priority Data

Jun. 15, 2011 (JP) ..... 2011-133507

(51) Int. Cl.
*H05B 37/02* (2006.01)
*H05B 33/08* (2006.01)

(52) U.S. Cl.
CPC ..... *H05B 33/0866* (2013.01)

(58) Field of Classification Search
CPC .... H05B 33/0803; H05B 37/02; H05B 33/08; H05B 33/0866; H05B 33/0875
USPC ..... 315/192, 185 R, 193, 209 R, 210, 291, 315/307, 308, 312
See application file for complete search history.

(56) References Cited

U.S. PATENT DOCUMENTS

| | | | | |
|---|---|---|---|---|
| 7,736,047 | B2 * | 6/2010 | Ohashi et al. | 362/631 |
| 8,011,794 | B1 * | 9/2011 | Sivertsen | 362/85 |
| 2006/0221636 | A1 | 10/2006 | Ohashi et al. | |
| 2008/0030185 | A1 * | 2/2008 | Metsker et al. | 323/304 |
| 2010/0289424 | A1 * | 11/2010 | Chang et al. | 315/250 |
| 2012/0049745 | A1 * | 3/2012 | Li et al. | 315/153 |

FOREIGN PATENT DOCUMENTS

| | | | |
|---|---|---|---|
| DE | 202004006292 | | 8/2004 |
| EP | 0 923 067 | | 6/1999 |
| JP | 2001-24226 | A | 1/2001 |
| JP | 2006-135007 | A | 5/2006 |
| JP | 2006-278125 | A | 10/2006 |
| JP | 2008-210588 | A | 9/2008 |
| JP | 2011-9233 | | 1/2011 |

OTHER PUBLICATIONS

Galit Mendelson, All You Need to Know About Power over Ethernet (POE) and the IEEE 802.3af Standard, Jun. 2004, PowerDsine Ltd., pp. 13 and 16.*

(Continued)

*Primary Examiner* — Jimmy Vu
(74) *Attorney, Agent, or Firm* — Renner, Otto, Boisselle & Sklar, LLP

(57) ABSTRACT

A light emitting device includes a set of light source units including multiple types of solid state light emitting elements having different light colors, each of the light source units comprising the same type of the solid state light emitting elements connected in series and; and an information storage unit which stores information about electrical characteristic of the set of light source units. The information stored in the information storage unit represents a relationship between a light output and a drive current in the set of light source units.

6 Claims, 3 Drawing Sheets

(56) References Cited

OTHER PUBLICATIONS

Pascal Unterdorfer, Power over Ethernet, Jun. 30, 2008, Hirschmann Automation and Control GmbH, p. 3.*
European Search Report dated Oct. 12, 2012 for corresponding European Application No. 12171584.1.
Japanese Office Action dated Dec. 16, 2014 issued in corresponding Japanese application No. 2011-133507 and English translation thereof.
European Office Action dated Feb. 25, 2015 issued in corresponding European application No. 12171584.1.

* cited by examiner

LIGHT EMITTING DEVICE AND ILLUMINATION APPARATUS HAVING SAME

FIELD OF THE INVENTION

The present invention relates to a light emitting device using a solid state light emitting element as a light source, and an illumination apparatus using the light emitting device.

BACKGROUND OF THE INVENTION

In recent years, there have been provided various light emitting devices and illumination apparatuses using a solid state light emitting element such as a light emitting diode and an organic electroluminescence (EL) element as a light source. In Japanese Patent Application Publication No. 2011-9233, for example, there is disclosed an illumination apparatus in which a plurality of light emitting modules (light emitting devices) are connected in parallel to a constant current source.

In the light emitting module, a resistor, a transistor and one or more light emitting diodes are connected in series between a pair of main terminals, and a resistor for outputting connection information (information output resistor) is connected between a joint of the light emitting diode and one of the main terminals and an information output terminal. The information output resistors of the light emitting modules all are set to substantially the same resistance value.

The constant current source includes a pair of output terminals connected to the pair of main terminals of the light emitting module, an input terminal to which the connection information outputted from the information output terminal is inputted, a variable constant current source whose output current is variable, and a control unit for varying the current outputted from the variable constant current source according to the connection information.

With the technology disclosed in Japanese Patent Application Publication No. 2011-9233, the control unit of the constant current source determines the number of the light emitting modules connected between the main terminals on the basis of a voltage inputted to the input terminal, and varies the output current of the variable constant current source according to the number of the light emitting modules connected such that a predetermined current flows in each of the light emitting modules. Accordingly, despite changes in the number of the light emitting modules connected between the main terminals of the constant current source, a predetermined current (e.g., a rated current) can flow constantly in each light emitting module.

Also, there has been provided an illumination apparatus having a dimming function of varying light intensity and a toning function of changing light color. In this case, the light emitting module is composed of three types of light emitting diodes including, e.g., red light emitting diodes, green light emitting diodes and blue light emitting diodes, and luminous color can be changed by individually driving the light emitting diodes.

However, the solid state light emitting element such as a light emitting diode tends to have a large variation in light output due to a difference in the use environment or the production lot compared with other light sources such as fluorescent lamps. For example, in case of light emitting diodes, there is a variation in the magnitude of forward current flowing when the same forward voltage is applied, thereby resulting in variations in the light output.

SUMMARY OF THE INVENTION

In view of the above, the present invention provides a light emitting device capable of suppressing a variation of light output due to individual differences in solid state light emitting elements, and an illumination apparatus using the same.

In accordance with a first aspect of the present invention, there is provided a light emitting device which includes a set of light source units including multiple types of solid state light emitting elements having different light colors, each of the light source units comprising the same type of the solid state light emitting elements connected in series and; and an information storage unit which stores information about electrical characteristic of the set of light source units, wherein the information stored in the information storage unit represents a relationship between a light output and a drive current in the set of light source units.

In the light emitting device, the information storage unit may include one or more resistive elements having a resistance value corresponding to the information.

Preferably, the information storage unit includes the resistive elements; and switch elements which separately switches on and off conduction of the resistive elements.

In accordance with a second aspect of the present invention, there is provided an illumination apparatus including one of the above described light emitting devices; a power supply unit which individually supplies a drive current to each of the light source units of the light emitting device; and an adjusting unit which obtains the information stored in the information storage unit, and adjusts the drive current supplied from the power supply unit to each of the light source units based on the obtained information.

With the present invention, it is possible to suppress variations in light output between light emitting devices due to individual variations among the light emitting diodes included therein.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, a light emitting device and an illumination apparatus using a light emitting diode as a solid state light emitting element in accordance with embodiments of the present invention will be described in detail. However, the technical concept of the present invention can be applied to a light emitting device and an illumination apparatus using a solid state light emitting element such as an organic electroluminescence (EL) element other than the light emitting diode, without being limited to those using the light emitting diode.

First Embodiment

Figure 1:
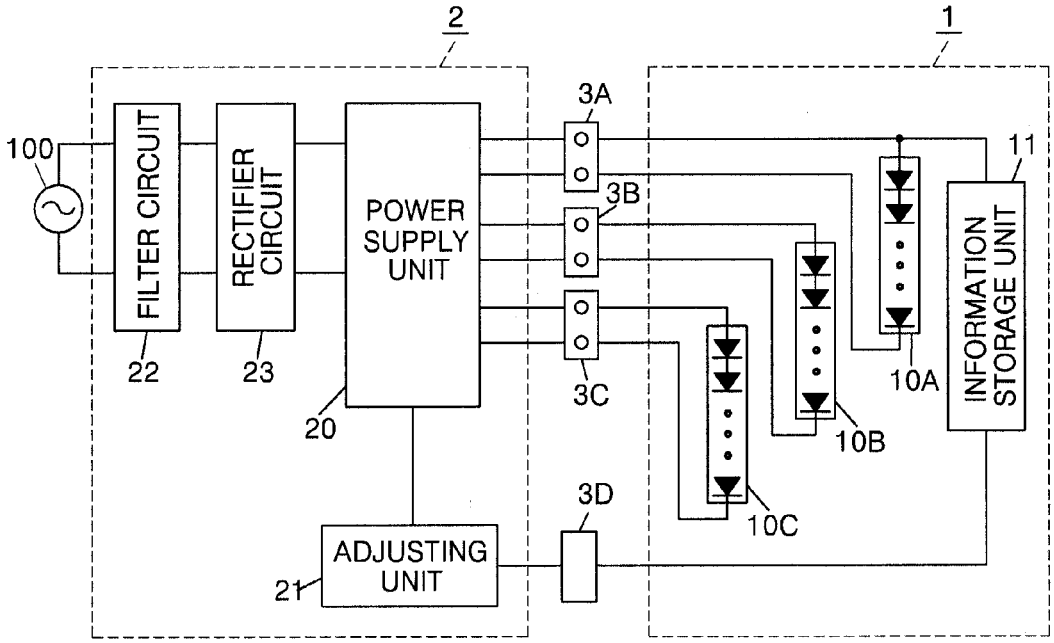
FIG. 1 is a block diagram showing a light emitting device and an illumination apparatus in accordance with a first embodiment of the present invention.

Referring to FIG. 1, an illumination apparatus in accordance with a first embodiment of the present invention includes a light emitting device 1, a lighting unit 2, and terminal blocks 3A, 3B and 3C. The light emitting device 1 includes three light source units 10A, 10B and 10C and an information storage unit 11. The light source unit 10A includes a plurality of red light emitting diodes connected in series. The light source unit 10B includes a plurality of green light emitting diodes connected in series. The light source unit 10C includes a plurality of blue light emitting diodes connected in series.

Further, red light, green light and blue light emitted from the light source units 10A, 10B and 10C are mixed to produce a color of light, e.g., white light, depending on a ratio of the amounts of the red, green and blue lights. Further, both ends of the light source units 10A, 10B and 10C are connected to the terminal blocks 3A, 3B and 3C, respectively.

The information storage unit 11 is formed of, e.g., resistive elements, which is set to a resistance value corresponding to a rank to which a group including the light source units 10A, 10B and 10C belongs, as will be described later. Further, both ends of the information storage unit 11, i.e., both ends of the resistive element, are connected to one end of the terminal block 3A connected to a positive terminal of the light source unit 10A and a terminal block 3D.

On the other hand, the lighting unit 2 includes a power supply unit 20, an adjusting unit 21, a filter circuit 22, a rectifier circuit 23 and the like. An AC voltage and current supplied from a commercial AC power source 100 is filtered by the filter circuit 22, rectified by the rectifier circuit 23, and inputted to the power supply unit 20. The power supply unit 20 includes, e.g., a step-up chopper circuit for power factor improvement, three step-down chopper circuits for stepping down a DC voltage outputted from the step-up chopper circuit and outputting the stepped-down voltage, and four drive circuits for driving the step-up chopper circuit and the three step-down chopper circuits respectively.

Output terminals of the three step-down chopper circuits are connected the terminal blocks 3A, 3B and 3C in a one-to-one manner, so that a drive current is individually supplied to each of the light source units 10A, 10B and 10C from each step-down chopper circuit. Further, the drive circuits of the step-down chopper circuits perform pulse-width modulation (PWM) control on switching elements constituting the step-down chopper circuits, and vary the light amount of each of the light source units 10A, 10B and 10C by increasing or decreasing the drive current supplied to each of the light source units 10A, 10B and 10C. Herein, since a circuit configuration of the power supply unit 20 is conventionally well known, detailed illustration and explanation of the circuit configuration will be omitted.

The adjusting unit 21 adjusts the drive current of each of the light source units 10A, 10B and 10C by controlling the power supply unit 20 to produce a desired light color (e.g., white). That is, the adjusting unit 21 outputs a dimming signal (PWM signal) to the drive circuit of each of the step-down chopper circuits of the power supply unit 20. Each drive circuit performs PWM control on the step-down chopper circuit according to the dimming signal, so that a target drive current can be supplied to each of the light source units 10A, 10B and 10C.

Further, the adjusting unit 21 obtains the information stored in the information storage unit 11 of the light emitting device 1 through the terminal block 3D, and adjusts the drive current supplied to each of the light source units 10A, 10B and 10C from the power supply unit 20 based on the obtained information. In addition, the adjusting unit 21 may be realized, e.g., by executing a program for adjustment of the drive current in a microcomputer.

Hereinafter, there will be described a method in which a rank is given to a set of three types of the light source units 10A, 10B and 10C having a different emission color from each other. For example, in case of mixing colors into white, a percentage of the light amount emitted from each of the red light source unit 10A, the green light source unit 10B and the blue light source unit 10C is uniquely determined, and it is possible to determine a target value of the drive current flowing into each of the light source units 10A, 10B and 10C according to the percentage.

Further, since the magnitude of the drive current is adjusted by the dimming signal applied to the drive circuit of the step-down chopper circuit, the dimming signal corresponding to the target value of the drive current is applied to each drive circuit and the drive current flowing into each of the light source units 10A, 10B and 10C is measured. Then, the rank is determined in five steps based on an error between the sum of the target values of the drive currents for the light source units 10A, 10B and 10C and the sum of the measured drive currents (=Sum of Measured values÷Sum of Target Values×100%).

For example, if the error is in the range of +1 to +3%, it is determined that the light emitting device is in rank 1, if the error is in the range of +3 to +5%, it is determined that it is in rank 2, and, if the error is in the range of −3 to −1%, it is determined that it is in rank 3. Further, if the error is in the range of −5 to −3%, it is determined that it is in rank 4, and if the error is in the range of −1 to +1%, it is determined that it is in rank 5. Then, there is provided the information storage unit 11 formed of a resistive element having a different resistance value corresponding to each of the ranks 1 to 5.

Next, the operation of the adjusting unit 21 in this embodiment will be described in more detail. First, when the AC power source 100 is turned on after the light emitting device 1 is connected to the lighting unit 2 via the terminal blocks 3A to 3D, the power supply unit 20 and the adjusting unit 21 of the lighting unit 2 start to operate. When the power supply unit 20 starts to operate, a DC current flows through the information storage unit 11 via the terminal block 3A, and a voltage drop according to the resistance value of the information storage unit 11 is inputted to the adjusting unit 21 through the terminal block 3D. The adjusting unit 21 obtains the information (the rank of the light emitting device 1) stored in the information storage unit 11 based on the voltage drop inputted through the terminal block 3D.

Then, the adjusting unit 21 adjusts the drive current supplied to each of the light source units 10A, 10B and 10C from the power supply unit 20 according to the rank of the light emitting device 1. For example, if the light emitting device 1 that is connected is in the rank 1, the adjusting unit 21 applies the dimming signal to each drive circuit to flow the drive current 3% less than the target value of the drive current flowing into each of the light source units 10A, 10B and 10C. If the light emitting device 1 that is connected is in the rank 4, the adjusting unit 21 applies the dimming signal to each drive circuit to flow the drive current 5% more than the target value of the drive current flowing into each of the light source units 10A, 10B and 10C.

As described above, the light emitting device 1 of this embodiment includes the information storage unit 11 storing the information about the electrical characteristics of the light source units 10A, 10B and 10C, i.e., the information representing the relationship between the drive current and the light output in each of the light source units 10A, 10B and 10C. When the light emitting device 1 is connected to the lighting unit 2, the adjusting unit 21 of the lighting unit 2 adjusts the drive current supplied to each of the light source units 10A, 10B and 10C from the power supply unit 20 based on the information obtained from the information storage unit 11. Therefore, it is possible to suppress variations in light output between light emitting devices 1 due to individual variations among the light emitting diodes included therein.

However, the method of determining the rank of the set including the light source units 10A, 10B and 10C is not limited to that described above. For example, after measuring the drive currents actually flowing when the dimming signals corresponding to the target values of the drive currents of the respective light source units 10A, 10B and 10C are applied to the respective drive circuits, the rank may be determined on the basis of differences in the target values and the measured values of the drive currents between the respective light source units 10A, 10B and 10C.

In this case, when one of the ranks 1 to 5 as described above is given to each of light source units, total 125 ranks can be given to a set of light source units. Further, since the drive circuit supplied to each light source unit is controlled independently, it is possible to obtain the accurate target color of light. Alternatively, the rank may be determined using a deviation in chromaticity coordinates between the target light color and the light color that is obtained when the dimming signal corresponding to the target value of the drive current for each of the light source units 10A, 10B and 10C is applied to each drive circuit.

Figure 2:
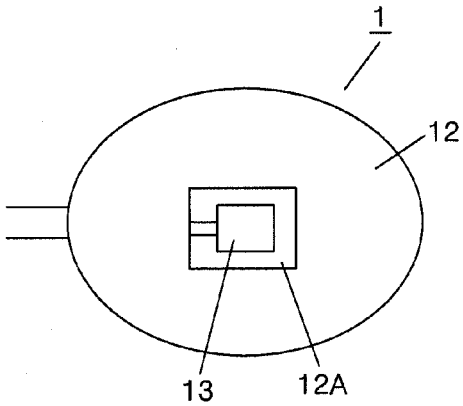
FIG. 2 is a plan view of the light emitting device shown in FIG. 1.

Here, as shown in FIG. 2, the light emitting device 1 may be configured such that the light source units 10A, 10B and 10C are mounted on a main substrate 12 having a substantially elliptical shape, and a mounting substrate 13 having the information storage unit 11 thereon is disposed in a rectangular opening 12A provided at the center of the main substrate 12. With this configuration, it is easy to replace the information storage unit 11 storing the information about the rank. Further, there is an advantage of simplifying a manufacturing process of the light emitting device 1.

Figure 3:
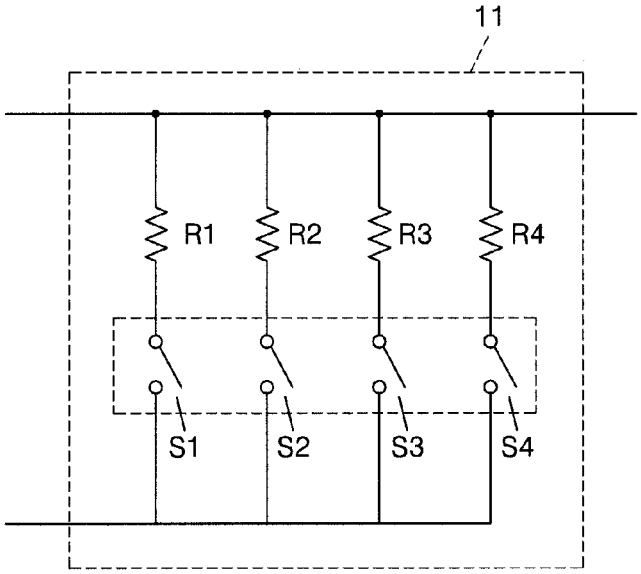
FIG. 3 is a circuit diagram illustrating a specific configuration of an information storage unit shown in FIG. 1.

In addition, the information storage unit 11 may be configured with a plurality of resistive elements. For example, it is possible to identify four ranks by using at least one of the resistive element of 500Ω and the resistive element of 1 kΩ. Alternatively, as shown in FIG. 3, the information storage unit 11 may be constituted by a plurality of resistive elements Rj (four resistive elements R1, R2, R3 and R4 in the illustrated example) and four switch elements Sj to separately switch on and off the conduction of each of resistive elements Rj (j=1, 2, 3, 4). A desired number of ranks can be identified by appropriately combining a plurality of resistive elements each having a specific resistance value.

Second Embodiment

Figure 4:
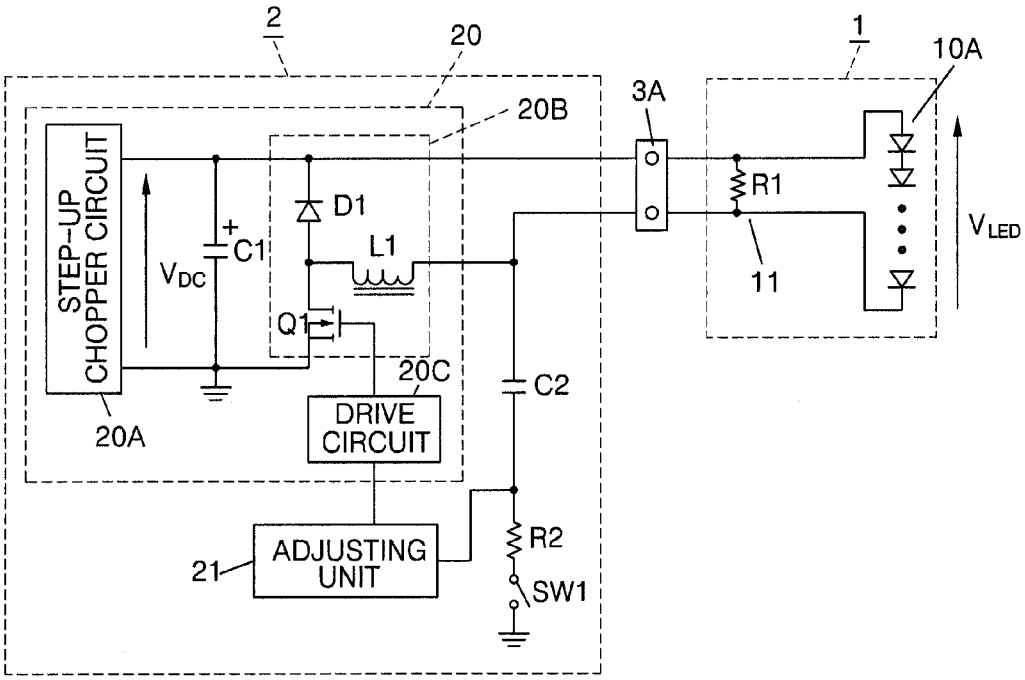
FIG. 4 is a block diagram partially showing a light emitting device and an illumination apparatus in accordance with a second embodiment of the present invention.

In the first embodiment, the adjusting unit 21 of the lighting unit 2 is connected to the information storage unit 11 of the light emitting device 1 via the dedicated terminal block 3D. In this embodiment, as shown in FIG. 4, a resistive element R1 as the information storage unit 11 is connected in parallel with the terminal block 3A connected to one of the light source units (e.g., 10A), which eliminates the need for the dedicated terminal block 3D. In the following description, since a basic configuration of this embodiment is almost the same as that of the first embodiment, the same reference numerals are assigned to the same components as the first embodiment, and illustration and description thereof will be omitted.

As shown in FIG. 4, the power supply unit 20 includes a step-up chopper circuit 20A, three (only one shown) step-down chopper circuits 20B and their drive circuits 20C. Further, the light source units 10B and 10C, the step-down chopper circuits and drive circuits therefor, the filter circuit and rectifier circuit are not illustrated in FIG. 4.

The step-down chopper circuit 20B includes a series circuit of a diode D1 and a switching element Q1, and a choke coil L1. The series circuit of the diode D1 and the switching element Q1 is connected across an electrolytic capacitor C1 for smoothing an output of the step-up chopper circuit 20A. Further, the choke coil L1 is connected between an anode of the diode D1 and a negative terminal of the terminal block 3A (i.e., the terminal connected to a cathode of the light emitting diode in the light source unit 10A). Herein, since the operation of the step-down chopper circuit 20B is conventionally well known, a detailed description thereof is omitted.

In the lighting unit 2, a series circuit of a capacitor C2, a resistor R2 and a switch SW1 is connected between the negative terminal of the terminal block 3A and the ground. The adjusting unit 21 performs switching control of the switching element Q1 of the step-down chopper circuit 20B through the drive circuit 20C, and turns on the switch SW1 when the switching element Q1 is off (when the step-down chopper circuit 20B is stopped).

If the switch SW1 is turned on, a voltage caused by charges charged in the electrolytic capacitor C1 is applied to the terminal block 3A, the voltage applied to the terminal block 3A is $V_{DC}$×R1/(R1+R2) when a voltage across the electrolytic capacitor C1 is VDC. Further, if the voltage $V_{DC}$ is higher than a forward voltage $V_{LED}$ of the light source unit 10A (the sum of forward voltages of the light emitting diodes which are connected in series), the discharge current from the electrolytic capacitor C1 flows through the resistor R1 of the information storage unit 11 to charge the capacitor C2.

Figure 5:
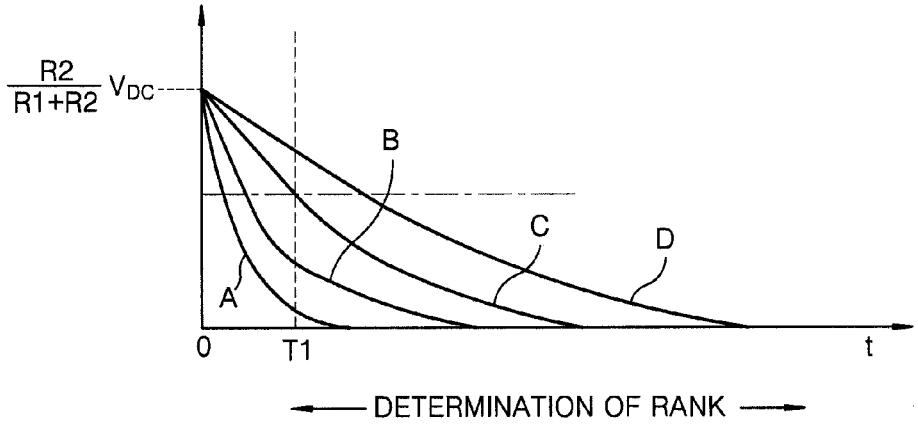
FIG. 5 is a diagram for explaining operation in accordance with the second embodiment of the present invention.

At this time, the potential of a connection point between the capacitor C2 and the resistor R2 is represented by VDC×R2/(R1+R2), and decreases with decrease in the voltage VDC across the electrolytic capacitor C1 (see FIG. 5). Further, a decreasing rate (time constant) of the potential of the connection point between the capacitor C2 and the resistor R2 varies depending on the resistance value of the resistor R1 (e.g., see curves A to D in FIG. 5).

Thus, the potential of the connection point between the capacitor C2 and the resistor R2 is monitored by the adjusting unit 21, and the ranks represented by the resistance value of the resistor R1 can be determined based on the potential at the time point when a certain time T1 has elapsed from the time point (t=0) when the switch SW1 is turned on. In addition, the ranks (curves A to D) may also be determined based on the elapsed time until the potential of the connection point between the capacitor C2 and the resistor R2 reaches a predetermined value since turning-on of the switch SW1.

Figure 6:
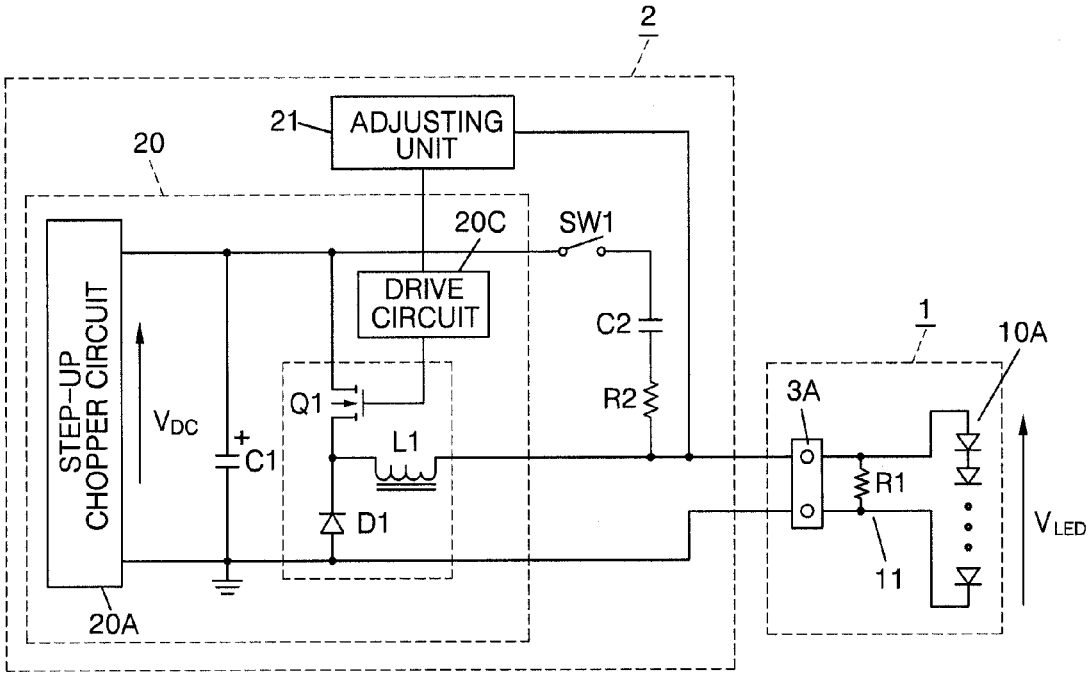
FIG. 6 is a block diagram partially showing another configuration of a lighting unit in the second embodiment of the present invention.

On the other hand, as shown in FIG. 6, one end of the light emitting device 1 (one end of the cathode side of the light source units 10A, 10B and 10C) may be connected to the ground. In this case, the arrangement of the switching element Q1 and the diode D1 in the step-down chopper circuit 20B is opposite to that of FIG. 4, and the series circuit of the resistor R2, the capacitor C2 and the switch SW1 is connected between a positive terminal of the terminal block 3A and a terminal of the high potential side of the electrolytic capacitor C1.

Thus, the adjusting unit 21 can monitor the potential of the connection point between the resistors R1 and R2, and determine the rank (curves A to D) represented by the resistance value of the resistor R1 based on the potential at the time point when a certain time T1 has elapsed from the time point (t=0) when the switch SW1 is turned on. Instead of the potential of the connection point between the resistors R1 and R2, the adjusting unit 21 may monitor the potential of the connection point between the resistor R2 and the capacitor C2.

While the invention has been shown and described with respect to the embodiments, it will be understood by those skilled in the art that various changes and modification may be made without departing from the scope of the invention as defined in the following claims.

What is claimed is:

1. A light emitting device comprising:

a set of light source units including multiple types of solid state light emitting elements having different light colors, each of the light source units comprising the same type of the solid state light emitting elements connected in series; and an information storage unit including at least one circuit element which stores information about electrical characteristic of the set of light source units for the information to be transmitted to an illumination apparatus after connection of the light emitting device to the illumination apparatus, wherein the information represents a relationship between a light output and a drive current of the set of light source units and represents an error in the drive current of the set of light source units due to a difference in a production lot or a use environment of the solid state light emitting elements such that, when the information is transmitted to the illumination apparatus after connection of the light emitting device to the illumination apparatus, the illumination apparatus determines the drive current provided to the light emitting device based on the information to suppress a variation in the light output of the set of light source units due to individual variations among the solid state light emitting elements.

2. The light emitting device of claim 1, wherein the information storage unit includes one or more resistive elements having a resistance value corresponding to the information.

3. The light emitting device of claim 2, wherein the information storage unit further includes the resistive elements; and switch elements which separately switches on and off conduction of the resistive elements.

4. An illumination apparatus comprising:

the light emitting device described in claim 1;

a power supply unit which individually supplies the drive current to each of the light source units of the light emitting device; and an adjusting unit which obtains the information stored in the information storage unit, and adjusts the drive current supplied from the power supply unit to each of the light source units based on the obtained information.

5. An illumination apparatus comprising:

the light emitting device described in claim 2;

a power supply unit which individually supplies the drive current to each of the light source units of the light emitting device; and an adjusting unit which obtains the information stored in the information storage unit, and adjusts the drive current supplied from the power supply unit to each of the light source units based on the obtained information.

6. An illumination apparatus comprising:

the light emitting device described in claim 3;

a power supply unit which individually supplies the drive current to each of the light source units of the light emitting device; and an adjusting unit which obtains the information stored in the information storage unit, and adjusts the drive current supplied from the power supply unit to each of the light source units based on the obtained information.

* * * * *